US008803750B2

(12) United States Patent
van Gils

(10) Patent No.: US 8,803,750 B2
(45) Date of Patent: Aug. 12, 2014

(54) LOW-HEIGHT ANTENNA HAVING AN ANTENNA PLANE AND A GROUND PLANE

(75) Inventor: Wijnand van Gils, Geertruidenburg (NL)

(73) Assignee: TE Connectivity Nederland B.V., 's-Hertogenbosch (NL)

( * ) Notice: Subject to any disclaimer, the term of this patent is extended or adjusted under 35 U.S.C. 154(b) by 438 days.

(21) Appl. No.: 12/930,720

(22) Filed: Jan. 13, 2011

(65) Prior Publication Data

US 2011/0169707 A1 Jul. 14, 2011

(30) Foreign Application Priority Data

Jan. 14, 2010 (EP) ..... 10150758

(51) Int. Cl.
*H01Q 13/10* (2006.01)
*H01Q 1/48* (2006.01)

(52) U.S. Cl.
USPC ..... 343/767; 343/793

(58) Field of Classification Search
USPC ..... 343/767, 793
See application file for complete search history.

(56) References Cited

U.S. PATENT DOCUMENTS

2003/0038749 A1* 2/2003 Chen ..... 343/700 MS
2004/0196200 A1* 10/2004 Sievenpiper ..... 343/770
2004/0217910 A1 11/2004 Montgomery et al.

FOREIGN PATENT DOCUMENTS

JP 7074533 A 3/1995
JP 07202537 A * 8/1995
JP 2008172697 A * 7/2008

OTHER PUBLICATIONS

R.W. Jackson, Coplanar Waveguide vs. Microstrip for Millimeter Wave Integrated Circuits, 1986, IEEE MTT-S Digest, pp. 699-702.*
European Search Report issued by the European Patent Office, Munich, Germany, dated Jun. 16, 2010, for related European patent Application No. 1015758.0; 6 pages.

* cited by examiner

*Primary Examiner* — Jacob Y Choi
*Assistant Examiner* — Jae Kim
(74) *Attorney, Agent, or Firm* — Faegre Baker Daniels LLP

(57) ABSTRACT

An antenna includes a ground plane and an antenna plane arranged on the ground plane by at least one bar. A feed line is guided sideways between the ground plane and the antenna plane to a feed contact of the antenna plane.

10 Claims, 2 Drawing Sheets

LOW-HEIGHT ANTENNA HAVING AN ANTENNA PLANE AND A GROUND PLANE

BACKGROUND

The invention relates to an antenna.

In the state of the art, different types of antennas are known which are suitable for sending and receiving data, for example using WIFI applications.

The European patent application EP 1401050 A1 describes an internal planar antenna for small radio apparatuses. The ground plane of the planar antenna is shaped such that it improves the matching of the antenna. The shaping may be carried out by means of one or more slots in the ground plane. The slot suitably changes the electrical length of the ground plane as viewed from the short-circuit point so that the ground plane will function as a radiator in an operating band of the antenna. The planar antenna is connected via a short-circuit conductor that extends from the planar antenna to the ground plane. The planar antenna is arranged above the ground plane with a predetermined distance. Furthermore, the planar antenna comprises a feed line conductor which is guided through the ground plane to the planar antenna.

The European patent application EP 0407145 A1 describes a broad-band mobile telephone antenna which comprises a first conductive circular plate and a second conductive circular plate. The first plate is located above and in parallel to the second plate. The diameter of the second plate is equal to or larger than that of the first plate. The second plate is used as a ground plate which is attached to a body of an automobile. A short-circuit rod for matching an impedance between the first plate and the second plate is used as an antenna and a coaxial feeder cable for the antenna is connected between the first and the second plate. An upper end of a core rod is connected to the first plate at the substantial center thereof. A low end of the core rod is extended towards an opening formed in the substantial center of the second plate. The opening is connected to a connector which is placed inside the automobile through an opening formed in the body. The connector connects the core rod and the coaxial cable which is connected to a transmitter/receiver of a mobile telephone system. The inner conductive wire of the coaxial cable is connected to the core rod and the outer conductive sheet is connected to the ground plate.

SUMMARY

The object of the invention is to provide an antenna with a low height.

The object of the invention is solved by an antenna having a ground plane and an antenna plane, whereby the antenna plane is arranged above the ground plane, whereby the antenna plane is electrically connected to the ground plane by at least one bar, whereby an electrical feed line is guided sideways between the ground plane and the antenna plane to a feed contact of the antenna plane.

The antenna has the advantage that it has a small height. The ground plane and the antenna plane are arranged at a small distance and connected by at least one bar. Furthermore, a feed line is guided sideways between the ground plane and the antenna plane.

The dependent claims refer to further embodiments of the antenna. A further embodiment of the antenna comprises an antenna plane made of a plate and at least one bar that is folded as a strap from the plate. This embodiment is inexpensive and simple in production.

A further embodiment of the antenna comprises a feed contact which is constituted by a bar folded from the antenna plate simplifying the construction of the antenna plate.

Another embodiment of the antenna comprises a feed line configured as a conductor strip. The conductor strip provides a reliable electrical connection and needs only little space.

Another embodiment of the antenna comprises an antenna plane with two halves which are axially symmetrically arranged according to a middle axis of symmetry improving the electrical function of the antenna.

Another embodiment of the antenna comprises a feed line which is arranged along the axis of symmetry improving the electrical quality of the antenna.

Another embodiment of the antenna comprises bars which are axially symmetrically arranged according to the axis of symmetry improving the electrical properties and function of the antenna.

A further embodiment of the antenna comprises one bar as an electrical short connection between the antenna plane and the ground plane, the bar comprising an opening, whereby the feed line is guided through the opening from the outside to an area between the ground plane and the antenna plane. The feed line is arranged on the ground plane. This embodiment requires only little space and has a simple structure.

Another embodiment of the antenna comprises an antenna plane in the shape of a triangle which shows improved electrical properties for the function of the antenna.

A further embodiment of the antenna comprises an antenna plane with a slit in a V-shape improving the electrical function of the antenna.

Another embodiment of the antenna comprises an antenna plane with a front side which is defined by a border line in the shape of a V.

Another embodiment of the antenna comprises an antenna plane with a slit and a border line of the antenna plane being arranged in parallel and symmetrically according to the axis of symmetry. This embodiment shows improved sending and receiving properties for the antenna function.

BRIEF DESCRIPTION OF THE DRAWINGS

The antenna is described according to the following figures.

DETAILED DESCRIPTION

Figure 1:
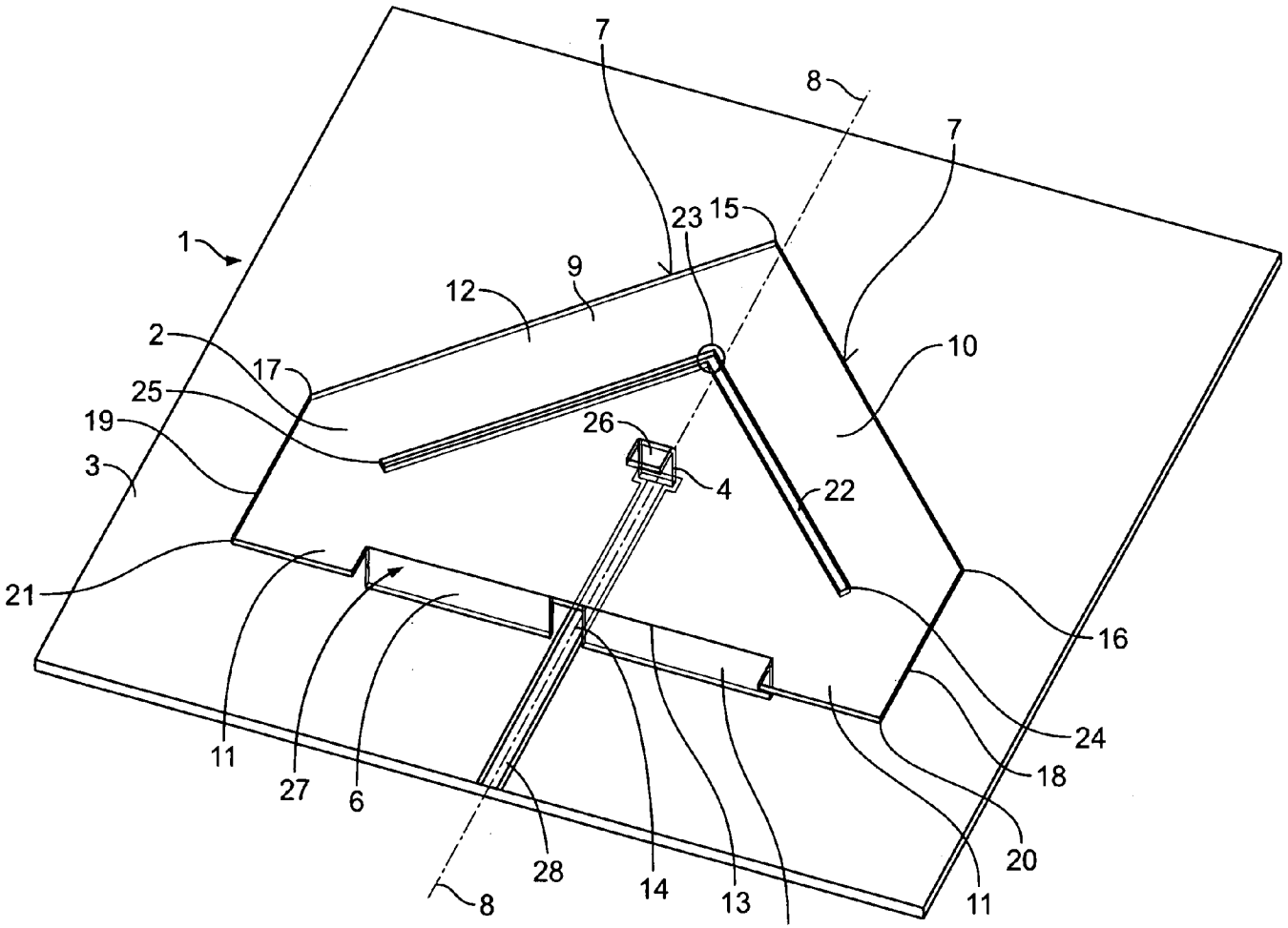
FIG. 1 depicts the antenna with a ground plane.

FIG. 1 depicts a schematic view of the antenna 1 which comprises an antenna plane 2 and a ground plane 3. In the depicted embodiment, the ground plane 3 has a larger area than the antenna plane 2. The ground plane 3 has a square area, whereby the antenna plane 2 is arranged above the ground plane 3 and in the middle of the ground plane 3. The antenna plane 2 is disposed in parallel to the ground plane 3 whereby the antenna plane 2 is connected to the ground plane 3 by at least one bar 4, 5, 6. The shown embodiment of the antenna comprises an antenna plane 2 with three bars 4, 5, 6.

The antenna plane 2 comprises a axis of symmetry 8 which divides the antenna plane 2 in two symmetrical halves 9, 10 which are axially symmetric to the axis of symmetry 8. The antenna plane 2 comprises a front side 12 with a front line 7 in the shape of a V. The antenna plane 2 comprises a rectangular back side area 11 which is adjacent to the triangularly shaped front side 12. The back side area 11 comprises a back rim 13 at which the second and the third bar 5, 6 are folded as straps from the antenna plane 2. In the shown embodiment, the second and the third bar 5, 6 are embodied in one piece with the antenna plane 2. The second and the third bar 5, 6 are punched and folded at a predetermined angle to the antenna plane 2. In the shown embodiment, the angle is 90° with regard to the antenna plane 2. The antenna plane 2 is basically a planar plane. The second and the third bar 5, 6 are embodied as rectangular planar strips which are arranged at opposite sides of the axis of symmetry 8. Between the second and third bar 5, 6, a free space 14 defining an opening is arranged axially symmetrically to the axis of symmetry 8.

The V-shaped front line 7 comprises a front point 15 and two side points 16, 17 at three edges. The front point 15 is arranged on the axis of symmetry 8. The first and second side points 16, 17 are arranged on opposite sides with regard to the axis of symmetry 8 with the same distance to the axis of symmetry 8. From the side points 16, 17 parallel side rims 18, 19 are guided to back points 20, 21. The first and second back point 20, 21 are arranged at opposite edges of the back side area 11 on opposite sides with regard to the axis of symmetry 8, having the same distance to the axis of symmetry 8. The first and second back points 20, 21 are arranged on the back rim 13 of the antenna plane 2.

The second and third bars 5, 6 are disposed at a predetermined distance from the first and second back points 20, 21. The second and the third bars 5, 6 comprise a rectangular shape. Also the opening of the free space 14 comprises a rectangular shape. In the shown embodiment, the antenna plane 2 comprises a V-shaped slit 22 which is arranged in parallel to the V-shaped front line 7. Furthermore, the V-shaped slit 22 is symmetrically arranged to the axis of symmetry 8, whereby a further front point 23 of the slit 22 which is arranged at an edge of the slit 22 is arranged on the axis of symmetry 8. Further back side points 24, 25 of the slit 22 which are arranged at ends of the slit 22 are disposed on opposite sides of the axis of symmetry 8 with the same distance to the axis of symmetry 8.

Depending on the used embodiment of the antenna, it is not necessary to provide a slit 22 or it is also possible to provide different shapes of a slit or different slits in the antenna plane 2.

The first bar 4 which in the shown embodiment is also punched and folded as a strap from an antenna plate as the antenna plane 2 is disposed axially symmetrically to the axis of symmetry 8. A face of the first bar 4 is arranged perpendicularly to the axis of symmetry 8 and perpendicularly to the antenna plane 2. As the first bar 4 is punched and folded from a plate, the antenna plane 2 comprises an opening 26 adjacent to the first bar 4 which is also arranged axially symmetrically to the axis of symmetry 8.

As the second and third bars 5, 6 are punched and folded from the back side area 11 of the antenna plate 2, the antenna plane 2 comprises a rectangular recess 27 at the back side which is arranged in the plane of the antenna plane and which is also arranged axially symmetrically to the axis of symmetry 8.

The antenna plane 2 is made of a conductive material, e. g. a metal plate. Depending on the used embodiment, there may also be a supporting plate on which an electrically conductive film is arranged to form the antenna plane 2.

The ground plane 3 may also be made of a conductive material, e. g. a metal plate. Furthermore, the ground plane 3 may also be made of a supporting plate which is covered with an electrical conductive film.

On the ground plane 3, a feed line 28 is arranged which is guided sideways between the ground plane 3 and the antenna plane 2 to the first bar 4. The first bar 4 disposes a feed contact of the antenna plane 2. The feed line 28 is an electrical conductor which is arranged along the axis of symmetry 8 and which is electrical insulated with regard to the ground plane 3. The feed line 28 is guided through the free space 14 between the second and third bar 5, 6. The feed line 28 is electrically connected by the first bar 4 which is also electrically connected to the antenna plane 2. The feed line 28 may be constructed as a micro-strip line.

The feed line 28 may be covered with an electrically insulating material or at least an electrically insulating layer may be arranged between the ground plane 3 and the feed line 28.

In the shown embodiment, the feed line 28 which is guided through the free space 14 between the short-circuits 5, 6 of the antenna plane 2 provides almost no degradation of the performance of the antenna.

The second and third bar 5, 6 connect the electrically conducting antenna plane 2 with the electrically conducting ground plane 3. The second and bars 5, 6 dispose short-circuits between the antenna plane 2 and the ground plane 3.

Figure 2:
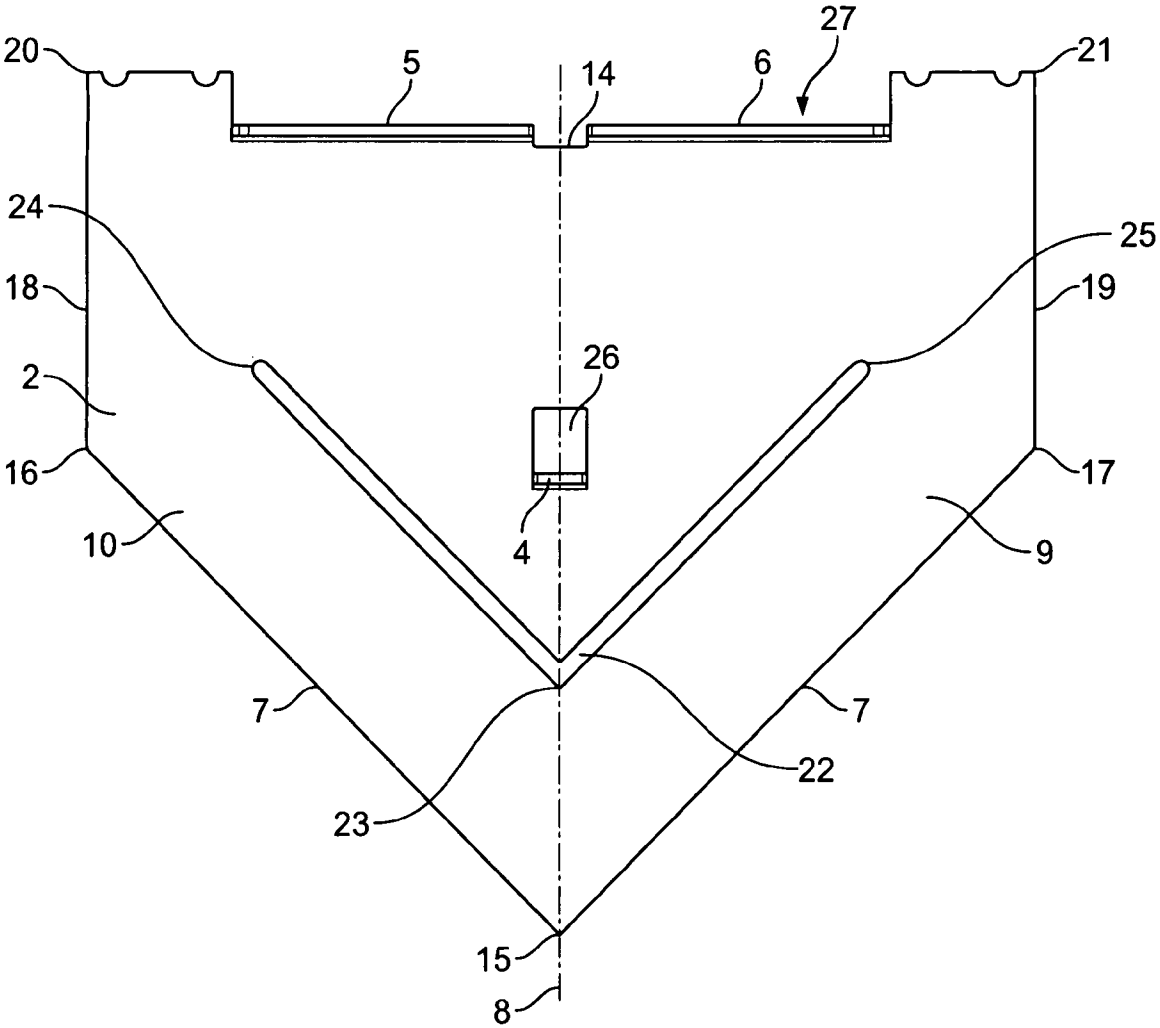
FIG. 2 depicts a top view onto the antenna.

FIG. 2 depicts a top view of the antenna plane 2. In this figure, the recess 27 and its symmetrical arrangement with regard to the axis of symmetry 8 can clearly be seen. Also the symmetrical arrangement of the first, second and third bar 4,5,6 and the V-shaped slit 22 and the V-shaped front line 7 of the antenna plane 2 are shown in FIG. 2.

Figure 3:
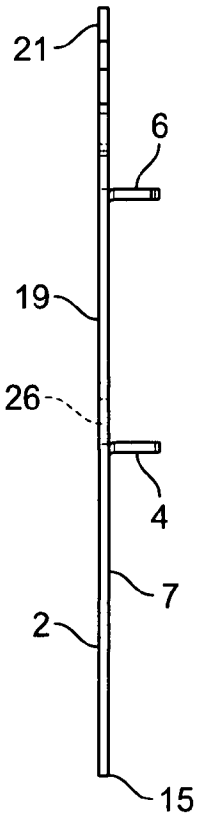
FIG. 3 depicts the antenna in a side view.

FIG. 3 depicts a side view of the antenna plane 2 showing the planar embodiment of the antenna plane 2 and the arrangement of the first, second and third bar 4, 5, 6. In the shown side view, only the third bar 6 can be seen. The first, second and third bars 4, 5, 6 protrude from the antenna plane 2 and are guided away from the antenna plane 2 to the ground plane 3 at a predetermined angle. In the shown embodiment, the predetermined angle is 90°. As the first, second and third bar 4, 5, 6 are made of the same material as the antenna plane 2 in one part, the thickness of the first, second and third bar 4,5,6 is the same as the thickness of the antenna plane 2. The antenna plane 2 may be fixed to the ground plane 3 by gluing, welding or soldering. The second and third bar 5, 6 may be connected to the ground plane in an electrically conducting manner, e.g. by an electrically conducting glue. However, the first bar 4 may be connected to the ground plane 3 in an electrically non-conducting manner, e.g. by an electrically insulating glue. Between the first bar 4 and the ground plane 3, no electrical connection is desired.

Depending on the used embodiment, the distance between the ground plane 3 and the antenna plane 2 may for example be between 0.5 mm and 4 mm. In the shown embodiment, there is no further material between the antenna plane 2 and the ground plane 3. The described antenna 1 has the advantage that it requires only a minimum amount of height. The antenna may be embodied as a dual-band antenna which can be placed on a metal ground plane with only a minimum height without sacrificing too much bandwidth. The antenna 1 may provide a design of a low-profile dual-band WIFI antenna. Furthermore, the provided antenna has the advantage that the feed line 28 is itself included within the small height of the antenna. The proposed arrangement of the electrically conducting feed line 28 along the axis of symmetry 8 generates almost no degradation of the performance of the antenna.

The proposed antenna 1 may comprise two parts. First, the low profile of the antenna is met by using a triangular-shaped antenna plane. The top of the antenna plane has the slit 22 with the shape of a V by which a second resonant band of the electrical function of the antenna is created. This design may permit a height of 3 mm for the antenna which operates at a e.g. WIFI 2.4 GHz band and at the WIFI 5 GHz band.

Second, part of the top of the antenna is used to create a feed towards the ground and the connection towards this feed can be created by means of a micro-strip line for example on the ground plane, or a cable connection. This feed line is guided to the antenna plane through an opening of the back, so the influence of the feed line on the antenna performance is minimal.

The proposed antenna has the advantage that a low-profile antenna pattern is provided which may operate at two different frequency bands, including a feed connection within this height.

The proposed antenna can be used in different devices and applications in which the available height of the antenna is required to be small. The antenna can be used for WIFI applications which are a specific system using wireless local area network. The antenna can also be used for cellular applications by scaling the current design towards the frequency band of cellular applications. Depending on the used embodiment, no material may be arranged between the antenna plane 2 and the ground plane 3. In a further embodiment, dielectric material may also be arranged between the ground plane and the antenna plane, whereby the feed line 28 is still arranged between the ground plane and the antenna plane. Depending on the used embodiment, different tracks may also be used for guiding the feeding conductor 28 to the antenna plane. For example, the feeding conductor 28 may be arranged on a lower side of the ground plane opposite to the antenna plane 2 and guided through an opening beneath the first bar 4 through an opening of the ground plane 3 to the first bar 4.

However, the arrangement of the feed line 28 on an upper side of the ground plane 3 and between the ground plane 3 and the antenna plane 2 has the further advantage that the feed line 28 is protected by the ground plane 3 and the antenna plane 2.

The invention claimed is:

1. An antenna comprising: a ground plane; an antenna plane shaped as an irregular pentagon with two parallel sides, each of the two sides being perpendicular to a base side of the irregular pentagon, whereby the antenna plane is arranged above the ground plane; a first bar folded down from the antenna plane and fixed to the ground plane; a second bar and a third bar folded down from the base side to have electrical contact with the ground plane, wherein the second and third bar are coplanar; an electrical feed line is positioned between the ground plane and the antenna plane and extends toward the first bar through a gap formed between the second and third bar; wherein the ground plane, antenna plane, the first bar, the second bar, the third bar, and the feedline are arranged such that the antenna has a line of symmetry that provides mirror symmetry.

2. An antenna according to claim 1, whereby the feed line is a conductor strip that is arranged on the ground plane.

3. An antenna according to claim 1, whereby the feed line is arranged along the line of symmetry.

4. An antenna according to claim 1, wherein the antenna plane comprises a third side and a fourth side, the third side is coupled to fourth side at an intersection positioned along the line of symmetry, and the third and fourth sides are angled away from each other and the line of symmetry.

5. An antenna according to claim 1, whereby the antenna plane comprises a slit having at least a first side and a second side, the first side is coupled to the second side, and the first and second sides are angled away from each other in a generally V-shape.

6. An antenna according to claim 4, whereby the third and fourth sides of the antenna plane define a front line of the antenna plane, and the third side extends diagonally from the line of symmetry of the antenna, and the fourth side extends diagonally from the line of symmetry.

7. An antenna according to claim 6, wherein a slit of the antenna plane and the front line of the antenna plane are arranged in parallel and are axially symmetrically with regard to the line of symmetry.

8. An antenna according to claim 1, wherein the second and third bars are configured to define a rear portion of the antenna plane, and the second and third bars define at least half of the rear portion.

9. An antenna according to claim 1, wherein the electrical feed line is spaced apart from a bottom surface of the ground plane.

10. An antenna according to claim 1, wherein the antenna plane is centrally located on the ground plane.

* * * * *